US009815641B2

(12) United States Patent
Murodate et al.

(10) Patent No.: US 9,815,641 B2
(45) Date of Patent: Nov. 14, 2017

(54) SHEET CONVEYING DEVICE AND IMAGE READING APPARATUS

(71) Applicant: BROTHER KOGYO KABUSHIKI KAISHA, Nagoya-shi, Aichi-ken (JP)

(72) Inventors: Yusuke Murodate, Nagoya (JP); Takashi Ohama, Iwakura (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/348,319

(22) Filed: Nov. 10, 2016

(65) Prior Publication Data

US 2017/0057765 A1 Mar. 2, 2017

Related U.S. Application Data

(63) Continuation of application No. 14/857,454, filed on Sep. 17, 2015, now Pat. No. 9,522,793.

(30) Foreign Application Priority Data

Sep. 22, 2014 (JP) ..... 2014-192971

(51) Int. Cl.

| | |
|---|---|
| ***B65H 1/26*** | (2006.01) |
| ***B65H 1/04*** | (2006.01) |
| ***B65H 1/28*** | (2006.01) |

(52) U.S. Cl.

CPC ..... *B65H 1/266* (2013.01); *B65H 1/04* (2013.01); *B65H 1/28* (2013.01); *B65H 2402/31* (2013.01); *B65H 2402/45* (2013.01); *B65H 2405/115* (2013.01); *B65H 2405/324* (2013.01); *B65H 2405/3322* (2013.01); *B65H 2801/39* (2013.01)

(58) Field of Classification Search

CPC . B65H 1/00; B65H 1/027; B65H 1/04; B65H 3/00; B65H 5/00; B65H 2405/32; B65H 2405/35; B65H 2405/324; B65H 2405/354

USPC ..... 271/3.14, 10.01, 162

See application file for complete search history.

(56) References Cited

U.S. PATENT DOCUMENTS

| | | | | |
|---|---|---|---|---|
| 9,522,793 | B2 * | 12/2016 | Murodate | B65H 1/04 |
| 2002/0056957 | A1 | 5/2002 | Sekine | |
| 2004/0188912 | A1 | 9/2004 | Kobayashi | |
| 2005/0035527 | A1 | 2/2005 | Oomori et al. | |
| 2005/0073085 | A1 | 4/2005 | Fukada et al. | |

(Continued)

FOREIGN PATENT DOCUMENTS

| | | |
|---|---|---|
| JP | 2002-145457 A | 5/2002 |
| JP | 2010-245624 A | 10/2010 |

*Primary Examiner* — David H Bollinger

(74) *Attorney, Agent, or Firm* — Merchant & Gould P.C.

(57) ABSTRACT

A sheet conveying device includes a conveyor, a first cover, a second cover movable in conjunction with the first cover, and a restricting portion movable between a restricting position at which the second cover is restricted from being moved from a first position toward a second position and an allowable position at which the second cover is allowed to be moved from the first position toward the second position. The restricting portion is located at the restricting position when the first cover is located at the closed position, and the restricting portion is moved from the restricting position to the allowable position in conjunction with the first cover when the first cover is moved from the closed position toward the opened position.

11 Claims, 12 Drawing Sheets

(56) References Cited

U.S. PATENT DOCUMENTS

| | | | |
|---|---|---|---|
| 2010/0225977 | A1 | 9/2010 | Osanai et al. |
| 2010/0252987 | A1 | 10/2010 | Furuyama et al. |
| 2015/0274448 | A1 | 10/2015 | Wang et al. |
| 2015/0307299 | A1 | 10/2015 | Kozaki |

* cited by examiner

SHEET CONVEYING DEVICE AND IMAGE READING APPARATUS

CROSS-REFERENCE TO RELATED APPLICATION

This application is a continuation of U.S. patent application Ser. No. 14/857,454, filed Sep. 17, 2015, which further claims priority from Japanese Patent Application No. 2014-192971 filed on Sep. 22, 2014, the entire contents of both of which are incorporated herein by reference.

TECHNICAL FIELD

The present disclosure relates to a sheet conveying device and an image reading apparatus.

BACKGROUND

Regarding an automatic document feeder (hereinafter, referred to as 'ADF') provided for an image reading apparatus, an apparatus of which an apparatus upper surface covering is configured by two moveable members arranged at adjacent positions has been known.

The related-art apparatus has a cover member and a discharge tray, each of which is configured to be rotatable. When the apparatus is not used, the cover member and the discharge tray form an outer covering of the apparatus. At the state where the apparatus is not used, one end of the discharge tray adjacent to the cover member is put on an upper side of one end of the cover member adjacent to the discharge tray. That is, the one end of the cover member and the one end of the discharge tray have parts overlapping with each other in an upper and lower direction. At this state, the cover member restricts the discharge tray from being rotated in a direction along which the one end of the discharge tray is moved downwards.

On the other hand, when using the apparatus, the cover member is rotated in an opening direction. At this time, the cover member is rotated in a direction along which the one end of the cover member is moved downwards. At this time, as described above, the restriction of the discharge tray by the cover member is released, so that it is rotated in the direction along which the one end of the discharge tray is moved downwards.

However, when the above-described structure is adopted, if the discharge tray is pressed from above at the state where the cover member and the discharge tray form the outer covering of the apparatus, the force is applied from the discharge tray, so that the one end-side of the cover member is moved in a downward direction and the cover member may be thus opened.

For this reason, the cover member is abruptly opened against an intention of a user who does not know that the cover member is opened when the discharge tray is pressed.

SUMMARY

Therefore, it is preferably to provide a sheet conveying device and an image reading apparatus capable of suppressing an outer covering configured to be openable and closable from being abruptly opened.

In one aspect of the disclosure, a sheet conveying device comprising: a conveyor configured to convey a sheet along a predetermined conveyance path; a first cover configured to be movable between a closed position and an opened position, wherein the first cover is configured to form a part of an outer covering surface of the sheet conveying device by a first surface at the closed position and to function as a support member configured to support a sheet to be fed to the conveyor or a sheet discharged from the conveyor on a second surface opposite to the first surface at the opened position; a second cover configured to be movable between a first position and a second position in conjunction with the first cover, wherein the second cover is located at the first position when the first cover is located at the closed position and is configured to form a part of the outer covering surface at a position adjacent to the first cover at the first position, and wherein the second cover is configured to be moved from the first position to the second position when the first cover is moved from the closed position to the opened position; and a restricting portion movable between a restricting position at which the second cover is restricted from being moved from the first position toward the second position and an allowable position at which the second cover is allowed to be moved from the first position toward the second position, wherein the restricting portion is located at the restricting position when the first cover is located at the closed position, and wherein the restricting portion is moved from the restricting position to the allowable position in conjunction with the first cover when the first cover is moved from the closed position toward the opened position.

According to the sheet conveying device configured as described above, even when an external force is applied to the second cover in a direction of moving the second cover from the first position toward the second position, the movement of the second cover is suppressed by the restricting portion. Therefore, the first cover is not moved from the closed position toward the opened position together with the second cover, and the first cover can be appropriately kept at the closed position.

In another aspect of the disclosure, an image reading apparatus comprising a sheet conveying device configured to convey a sheet to be read along a predetermined conveyance path, the sheet conveying device comprising: a conveyor configured to convey the sheet along the predetermined conveyance path; a first cover configured to be movable between a closed position and an opened position, wherein the first cover is configured to form a part of an outer covering surface of the sheet conveying device by a first surface at the closed position and to function as a support member configured to support a sheet to be fed to the conveyor or a sheet discharged from the conveyor on a second surface opposite to the first surface at the opened position; a second cover configured to be movable between a first position and a second position in conjunction with the first cover, wherein the second cover is located at the first position when the first cover is located at the closed position and is configured to form a part of the outer covering surface at a position adjacent to the first cover at the first position, and wherein the second cover is configured to be moved from the first position to the second position when the first cover is moved from the closed position to the opened position; and a restricting portion movable between a restricting position at which the second cover is restricted from being moved from the first position toward the second position and an allowable position at which the second cover is allowed to be moved from the first position toward the second position, wherein the restricting portion is located at the restricting position when the first cover is located at the closed position, and wherein the restricting portion is moved from the restricting position to the allowable position in conjunction with the first cover when the first cover is moved from the closed position toward the opened position.

According to the image reading apparatus configured as described above, since the image reading apparatus has the configuration corresponding to the sheet conveying device, it is possible to accomplish the same operations and effects as those of the sheet conveying device.

BRIEF DESCRIPTION OF THE DRAWINGS

The present disclosure is illustrated, and not limited, by way of example by the accompanying figures in which like reference numerals indicate similar elements.

DETAILED DESCRIPTION

Hereinafter, an exemplary illustrative embodiment of the sheet conveying device and the image reading apparatus will be described.

(1) First Illustrative Embodiment

[Configuration of Multi-Function Device]

Figure 1:
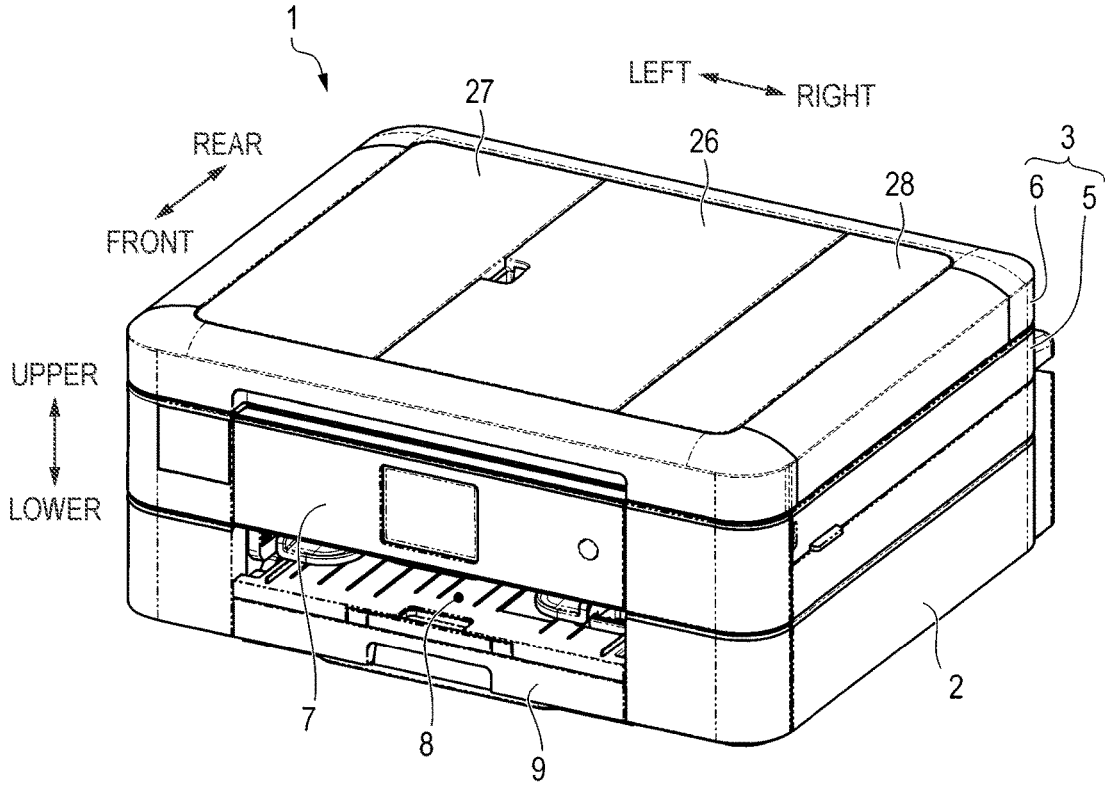
FIG. 1 is a perspective view illustrating an entire outward appearance of a multi-function device.

A multi-function device 1 shown in FIG. 1 is an apparatus having a configuration corresponding to an example of the sheet conveying device. Meanwhile, in below descriptions, in order to simply describe relative positional relations of respective units configuring the multi-function device 1, the upper, lower, left, right, front and rear directions are denoted in the drawings, and the descriptions are made using the respective directions. Among the directions, the upper and lower direction is a direction perpendicular to a horizontal surface when the multi-function device 1 is placed on the horizontal surface, the front is a direction toward which an operation panel 7 faces, the rear is a direction opposite to the front, and the right and left direction is the right and left direction when the multi-function device 1 is seen from the front. However, since the directions of moveable components and the like can be changed, it cannot be said that the directions denoted in the drawings are maintained all the time.

As shown in FIG. 1, the multi-function device 1 has a main body unit 2 and a reading unit 3 (which is an example of the image reading apparatus). In the main body unit 2, a control unit configured to control the entire multi-function device 1, an image forming unit, a LAN communication unit and the like are provided. The reading unit 3 is attached to an upper part of the main body unit 2 and is configured to be movable between a closed position and an opened position.

An upper surface of the main body unit 2 is formed with an opening (not shown). When the reading unit 3 is located at the closed position, the opening of the main body unit 2 is closed by the reading unit 3. When the reading unit 3 is located at the opened position, the opening of the main body unit 2 is opened, so that it is possible to perform maintenance for the components such as the image forming unit and the like accommodated in the main body unit 2 through the opening.

The reading unit 3 has a scanner unit 5 and an ADF unit 6 (which is an example of the sheet conveying device). The structures of the scanner unit 5 and the ADF unit 6 will be described later. A front surface of the multi-function device 1 is provided with the operation panel 7 that is to be operated by a user.

The operation panel 7 has an input device (for example, a touch panel, a variety of buttons and switches) that is to be operated by the user when inputting a variety of commands to the multi-function device 1, and an output device (for example, a liquid crystal monitor device and a variety of lamps) for notifying the user of an operating status and the like of the multi-function device 1.

A discharge port 8 for taking out a recording medium on which an image has been formed in the image forming unit is provided below the operation panel 7. A medium feeding cassette 8 in which recording media to be fed to the image forming unit are accommodated is attached below the discharge port 8.

[Details of Reading Unit]

Figure 2A:
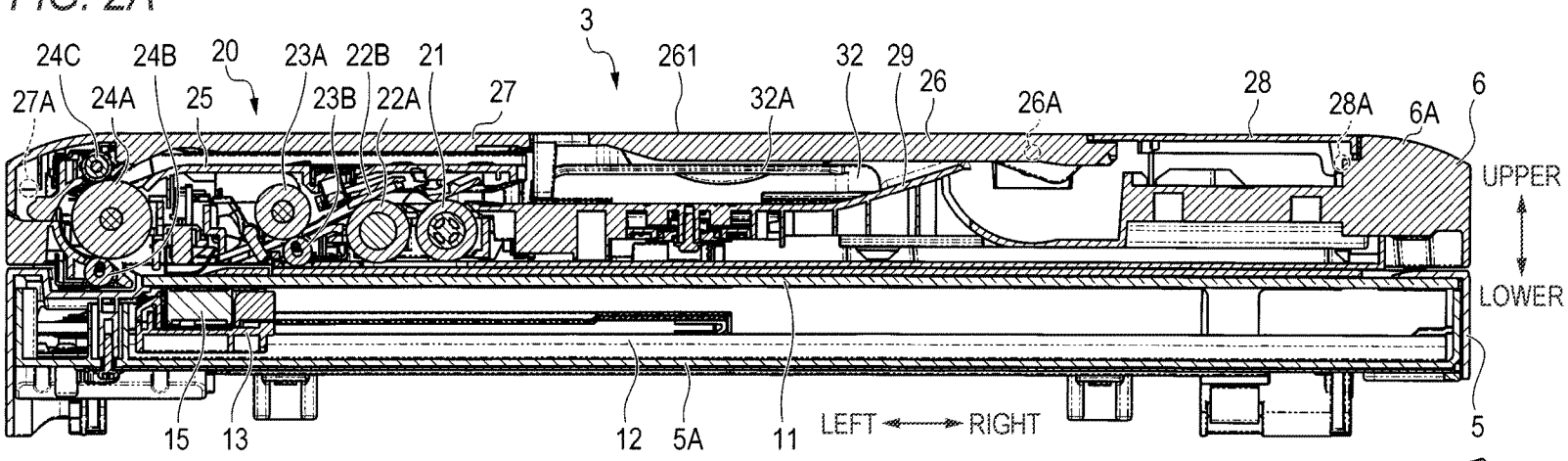
FIG. 2A is a central sectional view illustrating a reading unit at a state where a central cover is located at a closed position.
Figure 2B:
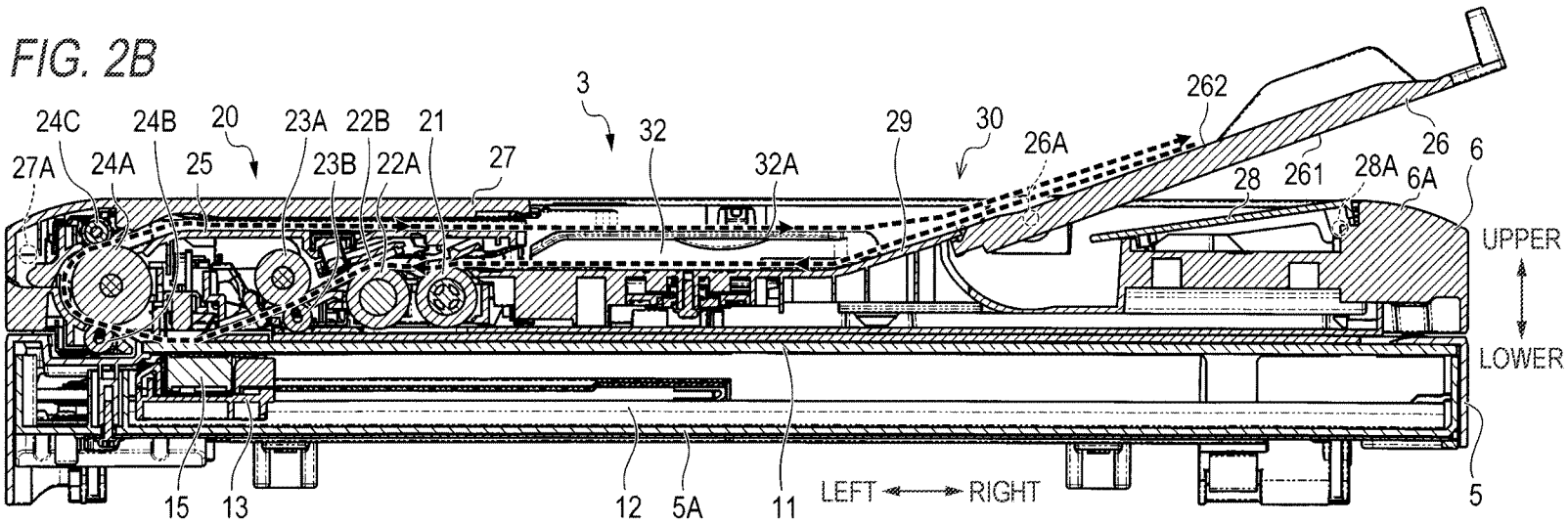
FIG. 2B is a central sectional view illustrating the reading unit at a state where the central cover is located at an opened position.

Subsequently, the structure of the reading unit 3 is described in more detail. In the reading unit 3, the scanner unit 5 is provided with a platen 11, a guide rail 12, a carriage 13, an image sensor 15 and the like, as shown in FIGS. 2A and 2B. The platen 11 is configured by a transparent plate member such as glass plate and acrylic plate and is configured to support a reading target on an upper surface of the scanner unit 5.

The guide rail 12 extends in parallel with a lower surface of the platen 11, and an extension direction thereof is the right and left direction in FIGS. 2A and 2B. Also, in this illustrative embodiment, the guide rail 12 is integrally formed on a bottom inner surface of a scanner base 5A, which is a base part of the scanner unit 5, by a resin material.

The carriage 13 is attached to an upper side of the guide rail 12, so that it is supported to reciprocally move in the right and left direction along the guide rail 12. The carriage 13 is coupled to an endless toothed belt (not shown). The toothed belt is driven to circulate in forward and reverse direction by a motor (not shown). At this time, the carriage 13 is configured to reciprocally move in the right and left direction in conjunction with the circulation of the toothed belt.

The image sensor 15 is one-dimensional image sensor having a plurality of reading elements arranged in one direction. In this illustrative embodiment, a contact image sensor (CIS) is adopted. The image sensor 15 is mounted to the carriage 13 so that the arranging direction of the reading elements is perpendicular to both the right and left direction and the upper and lower direction in FIGS. 2A and 2B, i.e., faces the front and rear direction and the respective reading elements face upwards.

In the reading unit 3, the ADF unit 6 is provided with a conveyor 20 configured to convey a sheet along a predetermined conveyance path (refer to a path shown with a dotted line in FIG. 2B), as shown in FIGS. 2A and 2B. The conveyor 20 has a suction roller 21, a separation roller 22A, a separation piece 22B, a relay roller 23A, a relay pinch roller 23B, a reversal roller 24A, a first reversal pinch roller 24B, a second reversal pinch roller 24C and the like. A guide part 25 extending along the conveyance path is arranged at a position at which the suction roller 21, the separation roller 22A, the separation piece 22B, the relay roller 23A, and the relay pinch roller 23B are covered from above. The components of the conveyor 20 are mounted to an ADF base 6A.

The ADF unit 6 is provided with the ADF base 6A, a central cover 26 (which is an example of the first cover), a left cover 27, and a right cover 28 (which is an example of the second cover). The central cover 26, the left cover 27 and the right cover 28 are rotatably supported to the ADF base 6A by pivotally supporting parts 26A, 27A, 28A, respectively.

One of a support shaft and a bearing configuring the pivotally supporting part 26A may be provided for the central cover 26 and the other may be provided for the ADF base 6A, which is a base part of the ADF unit 6, and the like (for example, the ADF base 6A itself or a member fixed to the ADF base 6A). Likewise, one of a support shaft and a bearing configuring the pivotally supporting part 27A may be provided for the left cover 27 and the other may be provided for the ADF base 6A and the like. One of a support shaft and a bearing configuring the pivotally supporting part 28A may be provided for the right cover 28 and the other may be provided for the ADF base 6A and the like.

At the closed position shown in FIG. 2A, the central cover 26 forms a part of an upper surface covering of the ADF unit 6 by a first surface 261. Also, at the opened position shown in FIG. 2B, the central cover 26 functions as a sub-tray (which is an example of the support member) capable of supporting a sheet by a second surface 262 (hereinafter, the central cover 26 is also referred to as the sub-tray 26). At the state shown in FIG. 2A, a main tray 29 integrally formed with the ADF base 6A is provided below the central cover 26.

When the sub-tray 26 is located at the opened position, the sub-tray 26 and the main tray 29 are arranged to be adjacent to each other. At a place at which the sub-tray 26 and the main tray 29 are adjacent to each other, boundary parts of the sub-tray 26 and the main tray 29 are substantially flush with each other. At this state, both the main tray 29 and the sub-tray 26 configure a sheet feed/discharge unit 30 configured to support a sheet being fed to the conveyor 20 or a sheet being discharged from the conveyor 20.

At the closed position shown in FIG. 2A, the left cover 27 forms a part of the upper surface covering of the ADF unit 6 by an upper surface thereof and covers the conveyor 20 and the guide part 25. At this state, the guide part 25 is arranged with a gap defining a conveyance path between the guide part and the left cover 27 being formed. When the left cover 27 is rotated to the opened position (the opened position is not shown), the conveyor 20 and the guide part 25 are exposed. Therefore, when the sheet is jammed in the conveyor 20, it is possible to remove the sheet by rotating the left cover 27 to the opened position.

The right cover 28 is configured to be movable between a first position shown in FIG. 2A and a second position shown in FIG. 2B, in conjunction with the central cover 26. When the central cover 26 is located at the closed position, the right cover 28 is located at the first position. The right cover 28 located at the first position forms a part of the upper surface covering of the ADF unit 6 at a position adjacent to the central cover 26. Also, when the central cover 26 is moved from the closed position to the opened position, the right cover 28 is moved from the first position to the second position and is thus retreated to a place at which the right cover does not interfere with the movement of the central cover 26.

Figure 3:
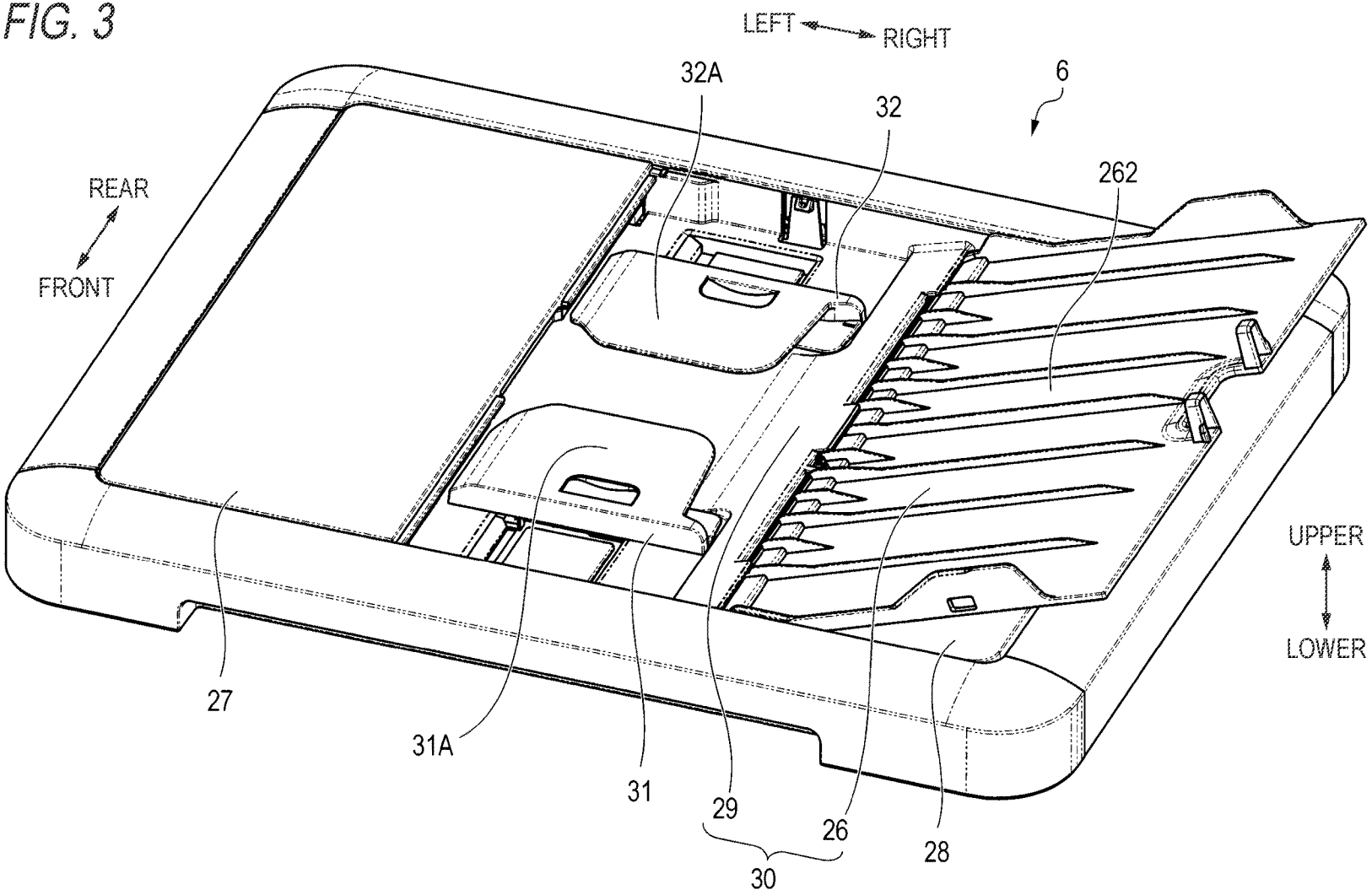
FIG. 3 is a perspective view illustrating an ADF unit at the state where the central cover is located at the opened position.

As shown in FIG. 3, side guides 31, 32 are provided on the main tray 29. The side guides 31, 32 are configured to slide in a width direction of the sheet (the front and rear direction in FIG. 3), thereby changing an interval in the width direction.

When sliding the side guides 31, 32, if a slide guide is slid, the other is slid in an opposite direction to the sliding direction of the slide guide being slid, in conjunction with the sliding. Thereby, it is possible to slide the side guides 31, 32 in a direction toward each other or in a direction away from each other.

The side guides 31, 32 are provided with extension parts 31A, 32A extending substantially horizontally from respective upper ends thereof in a direction of facing each other. When setting the sheet to be fed to the conveyor 20 on the sheet feed/discharge unit 30, the sheet is set below the extension parts 31A, 32A. At this state, the side guides 31, 32 are brought into contact with both end edges of the sheet in the width direction to restrict a setting position of the sheet on the main tray 29 and a sheet conveying direction. Thereby, it is possible to suppress the skews of the sheet being conveyed by the conveyor 20.

The sheet set on the sheet feed/discharge unit 30 is conveyed along the conveyance path shown with the dotted line in FIG. 2B. At this time, the sheet is delivered from an upper surface of the main tray 29 toward a downstream side in the conveying direction by the suction roller 21, and is separated one by one by the separation roller 22A and the separation piece 22B. The separated sheet is delivered toward a downstream side in the conveying direction by the relay roller 23A. The sheet delivered by the relay roller 23A is contacted to an upper surface of the platen 11, passes the contact place and reaches the reversal roller 24A. The sheet having reached the reversal roller 24A is delivered between the guide part 25 and the left cover 27 by the reversal roller 24A and is discharged from the conveyor 20.

The sheet discharged from the conveyor 20 is discharged above the extension parts 31A, 32A, and a part of the sheet reaches above the sheet feed/discharge unit 30 configured by the main tray 29 and the sub-tray 26 (central cover 26), depending on a size of the sheet. That is, in this illustrative embodiment, the sheet feed/discharge unit 30 also functions as a configuration for supporting the conveyed sheet discharged from the conveyor 20.

When reading an image of the sheet being conveyed by the conveyor 20, the image sensor 15 is stopped below the contact place of the sheet and the platen 11 between the relay roller 23A and the reversal roller 24A. Then, when the sheet being conveyed by the conveyor 20 passes through the contact place with contacting the upper surface of the platen 11, the image of the sheet is read through the platen 11.

When reading an image of the reading target supported by the platen 11, the carriage 13 reciprocates in the right and left direction. The image sensor 15 reciprocates in the right and left direction together with the carriage 13. The image sensor reads an image of the reading target through the platen 11 when moving rightward, for example.

[Details of Central Cover, Right Cover, Restricting Portion and Pressing Portion]

Figure 4A:
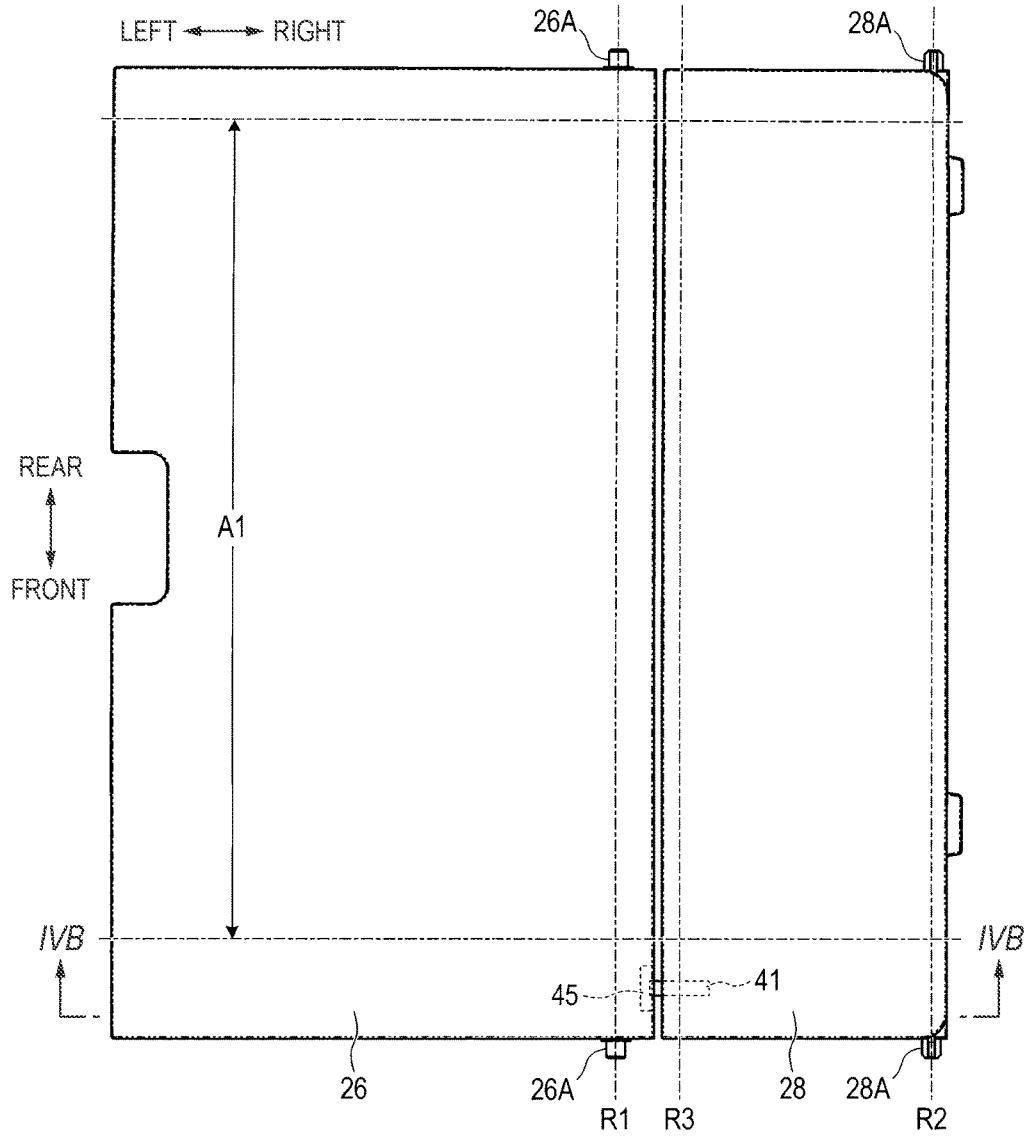
FIG. 4A is a plan view illustrating the central cover, a right cover and a restricting portion of a first illustrative embodiment.
Figure 4B:
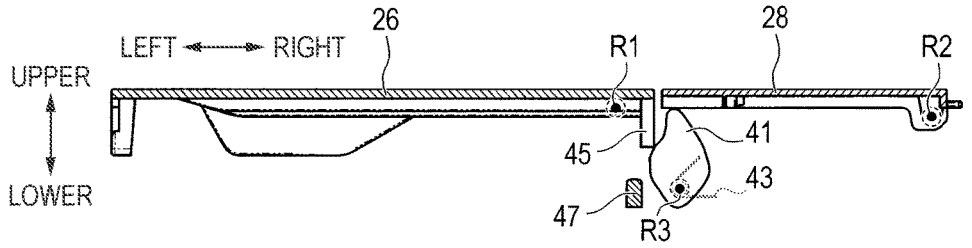
FIG. 4B is a sectional view taken along a line IVB-IVB of FIG. 4A.

A restricting portion 41 is provided at a place below the right cover 28 at the state where the central cover 26 is located at the closed position and the right cover 28 is located at the first position, as shown in FIGS. 4A and 4B. The restricting portion 41 is formed of a resin material (for example, polyamide, polyacetal, various engineering plastics and the like) having reduced friction coefficient and high wear resistance. An urging member 43 (a torsion coil spring, in this illustrative embodiment) is arranged in the vicinity of the restricting portion 41, as shown in FIG. 4B. A pressing portion 45 is provided at a place adjacent to front and right ends of the central cover 26 at the state where the central cover 26 is located at the closed position. The pressing portion 45 is a part formed integrally with the central cover 26 by the same resin material (for example, ABS resin) as the central cover 26, and has a wall shape protruding downwards from an end edge of the right cover 28 at the state where the central cover 26 is located at the closed position. At the state where the central cover 26 is located at the closed position, a lower end of the pressing portion 45 is contacted to a left surface of the restricting portion 41. In this illustrative embodiment, the lower end of the pressing portion 45 is contacted to the left surface of the restricting portion 41 at a right and lower corner part having a substantial right angle shape, as seen from the front (refer to FIG. 4B). The right and lower corner part may be chamfered to have an inclined surface or may be rounded to have a curved shape.

Also, in this illustrative embodiment, the pressing portion 45 straightly protrudes downwards from an end edge thereof facing the right cover 28 at the state where the central cover 26 is located at the closed position. However, the pressing portion 45 may obliquely protrude downwards. Also, a right surface of the pressing portion 45 is a planar surface perpendicular to an axis line extending in the right and left direction in FIG. 4B. However, the right surface of the pressing portion 45 may be a curved surface.

Also, in this illustrative embodiment, a width of the pressing portion 45 in the front and rear direction is wider than a width of the restricting portion 41 in the front and rear direction, as shown in FIG. 4A. However, the width of the pressing portion 45 in the front and rear direction and the width of the restricting portion 41 in the front and rear direction may be the same and the width of the pressing portion 45 in the front and rear direction may be narrower than the width of the restricting portion 41 in the front and rear direction.

In this illustrative embodiment, the restricting portion 41 is rotatably attached to the ADF base 6A, and is configured to be rotatable about a central axis of rotation R3 parallel with a central axis of rotation R1 of the central cover 26 and a central axis of rotation R2 of the right cover 28. As a support structure for rotatably attaching the restricting portion 41 to the ADF base 6A, a bearing may be provided for the restricting portion 41 and a support shaft may be provided for the ADF base 6A, or a bearing may be provided for the ADF base 6A and a support shaft may be provided for the restricting portion 41. The support shaft may be integrally formed with the restricting portion 41 or the ADF base 6A, or a separate metallic shaft may be attached to any one of the restricting portion 41 and the ADF base 6A and the other may be configured to be rotatable with respect to the metallic shaft.

In this illustrative embodiment, since the torsion coil spring is used as the urging member 43, the urging member 43 is attached to the support shaft configured to rotatably support the restricting portion 41. One of arms provided at both ends of the torsion coil spring, which is the urging member 43, is pressure-contacted to the ADF base 6A, and the other arm is pressure-contacted to the restricting portion 41. By the urging member 43, the restricting portion 41 is urged in a counterclockwise direction in FIG. 4B. At a state shown in FIG. 4B, the restricting portion 41 is rotated to a position (hereinafter, also referred to as a restricting position) at which it is contacted to the pressing portion 45, and the rotation beyond the position is restricted by the pressing portion 45. At the restricting position, an upper end of the restricting portion 41 is contacted to an opposite surface to a surface configuring an outer covering of the right cover 28, so that the restricting portion 41 restricts the right cover 28 from being moved from the first position toward the second position.

Figure 5A:
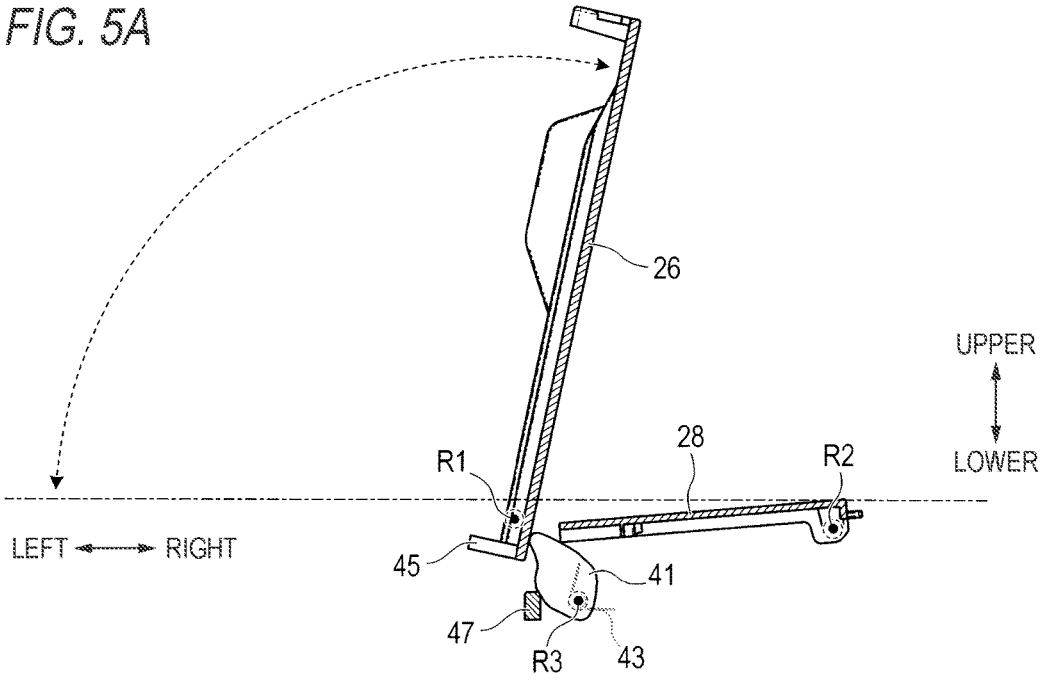
FIG. 5A illustrates the central cover rotated from the closed position toward the opened position by 102° and the right cover rotated in conjunction with the rotation.
Figure 5B:
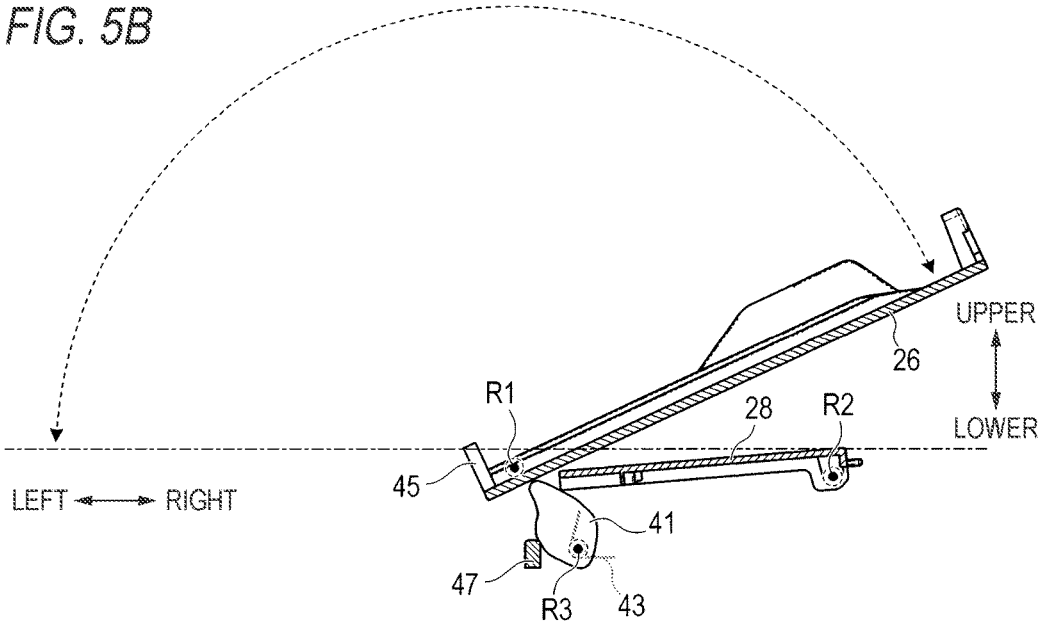
FIG. 5B illustrates the central cover rotated to the opened position and the right cover rotated in conjunction with the rotation.

When the central cover 26 is moved from the closed position shown in FIG. 4B to the opened position shown in FIG. 5B via a position shown in FIG. 5A, the restricting portion 41 is urged toward the central cover 26 by an urging force from the urging member 43. Therefore, even when the central cover 26 is moved, the restricting portion is rotated sliding relative to the central cover 26 while keeping the contact state with the central cover 26. As a result, while the central cover 26 is moved from the closed position shown in FIG. 4B to the position shown in FIG. 5A, the restricting portion 41 is moved to an allowable position shown in FIG. 5A while keeping the contact state with the pressing portion 45 or the central cover 26 by the urging force from the urging member 43.

Also, as the restricting portion 41 is moved from the restricting position to the allowable position, the right cover 28 is moved from the first position shown in FIG. 4B to the second position shown in FIG. 5A by its own weight contacting the right surface of the restricting portion 41. In other words, when the restricting portion 41 is located at the allowable position, the restricting portion 41 is configured to allow the right cover 28 to be moved from the first position to the second position. The upper end of the restricting portion 41 is located substantially just above the central axis of rotation R3 at the state where the restricting portion 41 is located at the restricting position shown in FIG. 4B, and is contacted at the tip portion thereof to the right cover 28 located at the first position. A curved surface of the restricting portion 41, which is located at the right of the upper end of the restricting portion 41, serves as a guide surface that guides the right cover 28 when the right cover 28 is moved between the first position and the second position. Also, the upper end of the restricting portion 41 and a curved surface located at the left of the upper end serve as a sliding surface that is configured to slide relative to the central cover 26 with contacting the central cover 26 while the restricting portion 41 is moved from the restricting position shown in FIG. 4B to the allowable position shown in FIG. 5A.

When the restricting portion 41 reaches the allowable position shown in FIG. 5A, the restricting portion 41 is contacted to a stopper 47. In this illustrative embodiment, the stopper 47 is a projection integrally formed with the ADF base 6A by a resin material. However, the stopper 47 may be integrally formed with a separate member, rather than the ADF base 6A. Alternatively, the stopper 47 configured as a separate member may be attached to the ADF base 6A or a separate member, not the ADF base 6A.

When the restricting portion 41 is contacted to the stopper 47, the restricting portion 41 is restricted from rotating further. For this reason, while the central cover 26 is further moved from the position shown in FIG. 5A to the opened position shown in FIG. 5B, the restricting portion 41 and the right cover 28 are not moved, and the pressing portion 45 or the central cover 26 are spaced from the restricting portion 41 and reach the opened position shown in FIG. 5B.

Also, even when the central cover 26 is moved from the opened position shown in FIG. 5B to the position shown in FIG. 5A, the restricting portion 41 and the right cover 28 are not moved, and when the central cover 26 reaches the position shown in FIG. 5A, the central cover 26 is contacted to the restricting portion 41. While the central cover 26 is further moved from the position shown in FIG. 5A toward the closed position shown in FIG. 4B, the central cover 26 or the pressing portion 45 press the restricting portion 41 against the urging force from the urging member 43.

Thereby, the restricting portion 41 is moved from the allowable position shown in FIG. 5A to the restricting position shown in FIG. 4B with contacting the pressing portion 45 or the central cover 26. At this time, the right cover 28 is applied with the force from the restricting portion 41 and is thus moved from the second position shown in FIG. 5A to the first position shown in FIG. 4B. As a result, the restricting portion 41 is returned to the state where the right cover 28 is restricted from being moved from the first position to the second position.

When the central cover 26 functions as the sub-tray 26, a part of an entire range in a width direction orthogonal to the sheet conveying direction on the central cover 26 is used as a conveyance area A1 of the sheet (refer to FIG. 4A). A width of the conveyance area A1 (a width in the front and rear direction shown in FIG. 4A) corresponds to a distance between the side guides 31, 32 of which the interval is enlarged to the maximum width in the front and rear direction. For this reason, when the sheet is discharged from the conveyor 20, the sheet is delivered on the sub-tray 26 toward a downstream side in the conveying direction in the conveyance area A1.

Regarding the conveyance area A1, the pressing portion 45 is provided at a position deviating from the conveyance area A1, as shown in FIG. 4A. Also, the restricting portion 41 is configured to contact the pressing portion 45 and the right cover 28 at a position deviating from the conveyance area A1, in correspondence to the pressing portion 45 located at the corresponding position.

For this reason, when the pressing portion 45 is provided at the above-described position, it is possible to suppress the sheet, which is being delivered toward a downstream side in the conveying direction in the conveyance area A1, from catching with the pressing portion 45. In the meantime, when a plurality of sheets is discharged from the conveyor 20, the previously discharged sheet may be pushed by the sheet being discharged thereafter. In this case, the previously discharged sheet may be slightly inclined and protrude beyond the conveyance area A1. However, since the pressing portion 45 is provided at the position sufficiently spaced from the conveyance area A1, considering the inclination of the sheet, it is also possible to suppress the inclined sheet from interfering with the pressing portion 45.

As described above, according to the multi-function device 1, when the external force is applied to the right cover 28 in the direction of moving the right cover 28 from the first position to the second position, the movement of the right cover 28 is suppressed by the restricting portion 41. Therefore, for example, when the load is applied in a downward direction from the outer covering-side of the right cover 28, the central cover 26 is not moved from the closed position toward the opened position by the load, so that it is possible to appropriately keep the central cover 26 at the closed position.

Also, according to the multi-function device 1, the pressing portion 45 is provided at the position deviating from the conveyance area A1. For this reason, the sheet being fed to the conveyor 20 or the sheet being discharged from the conveyor 20 is conveyed without interfering with the pressing portion 45. Therefore, it is not necessary to design a configuration where the pressing portion 45 is positioned in the conveyance area A1, for example, a shape of the pressing portion 45 with which the sheet is difficult to interfere, and it is possible to design the pressing portion 45 on the basis of the functions thereof Further, according to the multi-function device 1, when the central cover 26 is located at the closed position shown in FIG. 4B, the restricting portion 41 is located at the position at which it supports the right cover 28 from below at the upper end thereof positioned just above the central axis of rotation R3. Also, although the restricting portion 41 is urged toward the central cover 26 by the urging member 43, the restricting portion 41 is contacted to the pressing portion 45 and thus the upper end of the urging member 43 cannot be further rotated toward the central cover 26. Due to this positional relation, when the load is applied to the right cover 28, it is possible to suppress a component force, which acts in the direction of rotating the restricting portion 41 toward the allowable position, from being generated. Also, the force of the load is mainly received by the restricting portion 41, so that it is possible to suppress the force of the load from being applied to the central cover 26. As a result, it is possible to suppress both the right cover 28 and the central cover 26 from rattling in the right and left direction shown in FIG. 4B.

(2) Second Illustrative Embodiment

Subsequently, a second illustrative embodiment is described. In the meantime, since the second illustrative embodiment and illustrative embodiments thereafter have many common parts to the first illustrative embodiment, the descriptions are made on the basis of differences from the first illustrative embodiment, the common parts are denoted with the same reference numerals as the first illustrative embodiment and the detailed descriptions thereof are omitted.

Figure 6A:
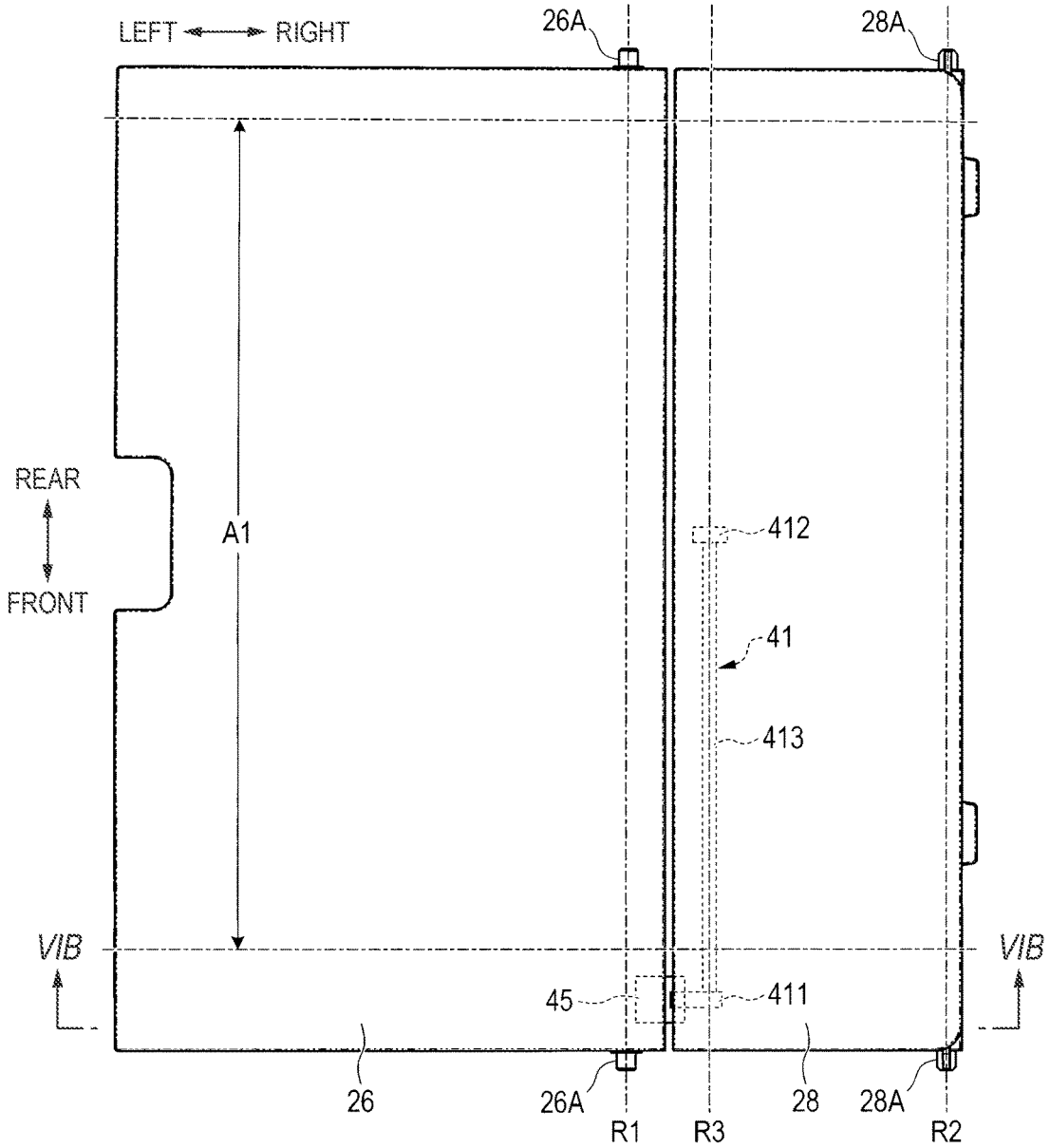
FIG. 6A is a plan view illustrating the central cover, the right cover and the restricting portion of a second illustrative embodiment.
Figure 6B:
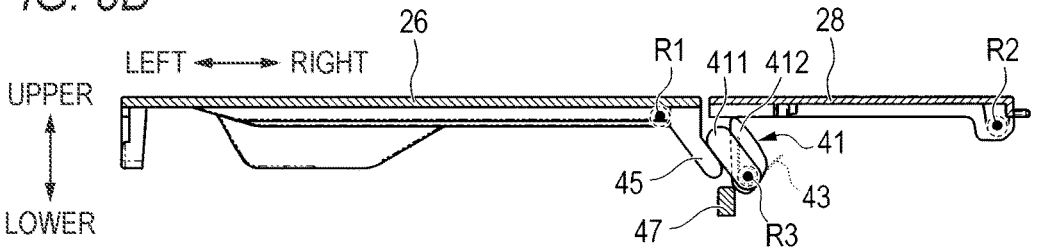
FIG. 6B is a sectional view taken along a line VIB-VIB of FIG. 6A.

In the second illustrative embodiment, the shapes and the like of the restricting portion 41 and the pressing portion 45 are different from the first illustrative embodiment. Specifically, as shown in FIGS. 6A and 6B, the restricting portion 41 exemplified in the second illustrative embodiment has a first part 411 capable of being contacted to the pressing portion 45, a second part 412 capable of being contacted to the right cover 28 at a substantial center of the right cover 28 in the width direction (front and rear direction shown in FIG. 6A), and a coupling part 413 configured to couple the first part 411 and the second part 412 so that the first part 411 and the second part 412 can be integrally moved.

In this illustrative embodiment, the coupling part 413 is configured by a metallic shaft of which a sectional shape perpendicular to an axis direction is circular, and the metallic shaft is attached to the ADF base 6A, so that the coupling part 413 is supported to be rotatable about the central axis of rotation R3. The first part 411 and the second part 412 are formed of a resin material (for example, polyamide, polyacetal or various engineering plastics) having high slidability and wear resistance, and are respectively attached to both ends of the metallic shaft configuring the coupling part 413, so that they are configured to be rotatable together with the coupling part 413. That is, in the first illustrative embodiment, the restricting portion 41 is formed of the single material. However, the restricting portion 41 may be configured by a combination of a plurality of materials (for example, metal and resin materials), depending on a shape and a function of the restricting portion 41.

Like the pressing portion 45 and the restricting portion 41 of the first illustrative embodiment, the pressing portion 45 and the first part 411 are provided at positions deviating from the conveyance area A1. However, the second part 412 and the coupling part 413 are arranged at positions at which they overlap with the conveyance area A1, as seen from above (refer to FIG. 6A), unlike the restricting portion 41 of the first illustrative embodiment. However, when the central cover 26 functions as the sub-tray 26, it is possible to avoid the contact of the sheet and the pressing portion 45 if the pressing portion 45 is located at the position deviating from the conveyance area A1. Therefore, the arrangement where the second part 412 and the coupling part 413 are located at positions overlapping with the conveyance area A1 is not problematic.

Instead, when the restricting portion 41 is located at the restricting position (refer to FIG. 6A), since the second part 412 is contacted to the right cover 28 at the substantial center of the right cover 28 in the width direction (the front and rear direction shown in FIG. 6A), it is possible to effectively suppress the right cover 28 from being bent downwards.

That is, since the right cover 28 is pivotally supported at the pivotally supporting parts 28A, 28A provided at both front and rear ends of the right end thereof, a part of the right cover 28 in the vicinity of a central part of the left end in the front and rear direction is the furthest spaced portion from the pivotally supporting parts 28A, 28A. For this reason, when the right cover 28 is bent, the part of the right cover 28 in the vicinity of the central part of the left end in the front and rear direction is most likely to be moved. However, when the second part 412 is contacted to the part that is likely to be moved, it is possible to effectively suppress the right cover 28 from being moved downwards with being bent at the corresponding part.

Therefore, as described above, when it is intended to suppress the bending of the right cover 28, it is preferable to adopt the configuration of the second illustrative embodiment. In the meantime, the restricting portion 41 exemplified in the first illustrative embodiment has a more compact structure than the restricting portion 41 exemplified in the second illustrative embodiment. Therefore, when focusing on a compact structure of the restricting portion 41, it is preferable to adopt the configuration of the first illustrative embodiment.

Meanwhile, according to the second illustrative embodiment, at the state where the central cover 26 is located at the closed position, a lower end of the pressing portion 45 obliquely protrudes in a right and lower direction from the central cover 26, as seen from the front (refer to FIG. 6B). Also, at the state where the central cover 26 is located at the closed position, the first part 411 obliquely extends in a left and upper direction from the vicinity of the central axis of rotation R3, as seen from the front (refer to FIG. 6B), and a tip portion thereof in the extension direction has a round shape. The tip portion of the first part 411 in the extension direction and a left surface of the tip portion define a sliding surface on which the restricting portion 41 slides relative to the pressing portion 45 with contacting the pressing portion 45 while the restricting portion 41 is moved from the restricting position shown in FIG. 6B to the allowable position shown in FIG. 7A.

Figure 7A:
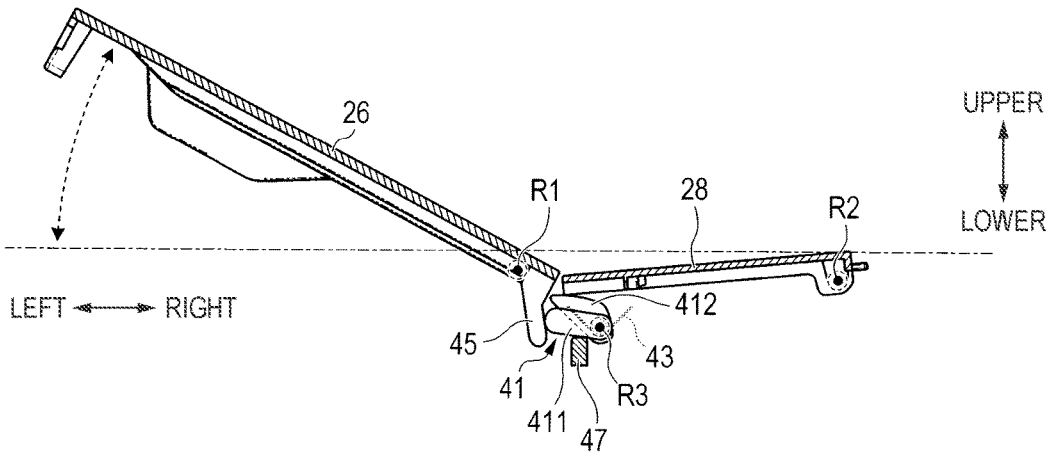
FIG. 7A illustrates the central cover rotated from the closed position toward the opened position by 28° and the right cover rotated in conjunction with the rotation of the central cover.

When the restricting portion 41 is moved to the allowable position shown in FIG. 7A, the stopper 47 is contacted to the first part 411. At the state where the restricting portion 41 is located at the restricting position shown in FIG. 6B, the upper end of the second part 412 is contacted to the right cover 28 located at the first position. A curved surface of the second part 412, which is located at the right of the upper end of the second part 412, defines a guide surface that guides the right cover 28 when the right cover 28 is moved between the first position and the second position.

Figure 7B:
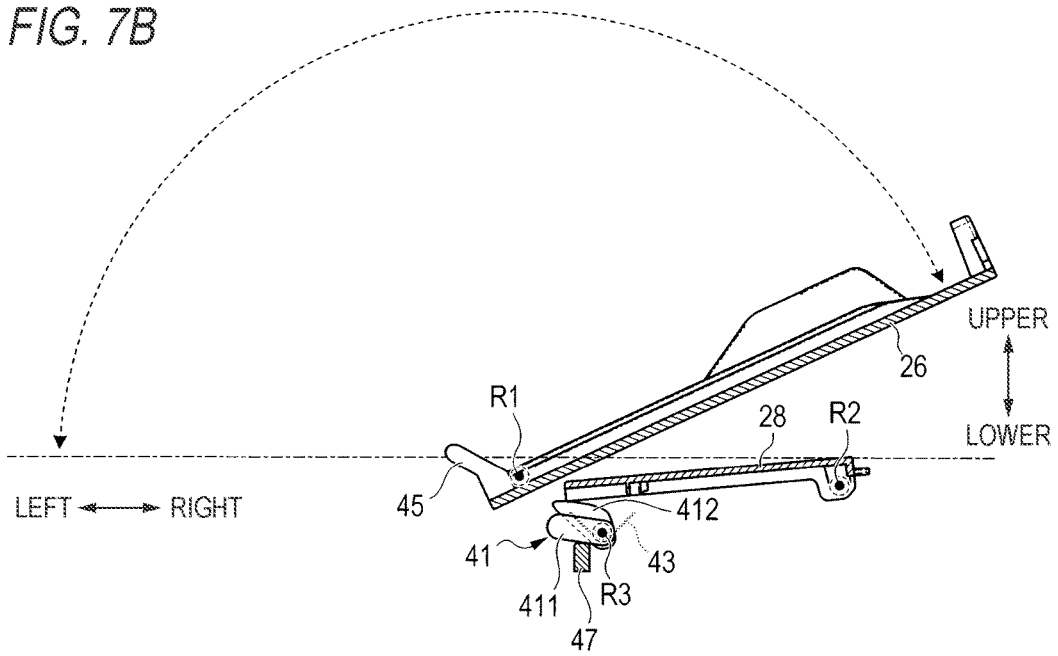
FIG. 7B illustrates the central cover rotated to the opened position and the right cover rotated in conjunction with the rotation of the central cover.

When the restricting portion 41 configured as described above is provided, the first part 411 is moved with contacting the pressing portion 45 until the central cover 26 is moved from the closed position shown in FIG. 6B to the position shown in FIG. 7B. At this time, the restricting portion 41 is moved from the restricting position to the allowable position. Also, the right cover 28 is moved from the first position to the second position. Then, while the central cover 26 is further moved from the position shown in FIG. 7A to the opened position shown in FIG. 7B, the restricting portion 41 is kept at the allowable position and the right cover 28 is kept at the second position.

Also, while the central cover 26 is moved from the opened position shown in FIG. 7B to the position shown in FIG. 7A, the restricting portion 41 is kept at the allowable position and the right cover 28 is kept at the second position. Then, the pressing portion 45 presses the first part 411 against the urging force from the urging member 43 and is moved with contacting the first part 441 until the central cover 26 is further moved from the position shown in FIG. 7A to the closed position shown in FIG. 6B. At this time, the restricting portion 41 is moved from the allowable position to the restricting position. Also, the right cover 28 is moved from the second position to the first position.

Therefore, when the configuration exemplified in the second illustrative embodiment is adopted, it is possible to accomplish the same operations and effects as the first illustrative embodiment. Also, when the load is applied to the right cover 28, it is possible to suppress the central cover 26 from being moved from the closed position toward the opened position.

(3) Third Illustrative Embodiment

Figure 8A:
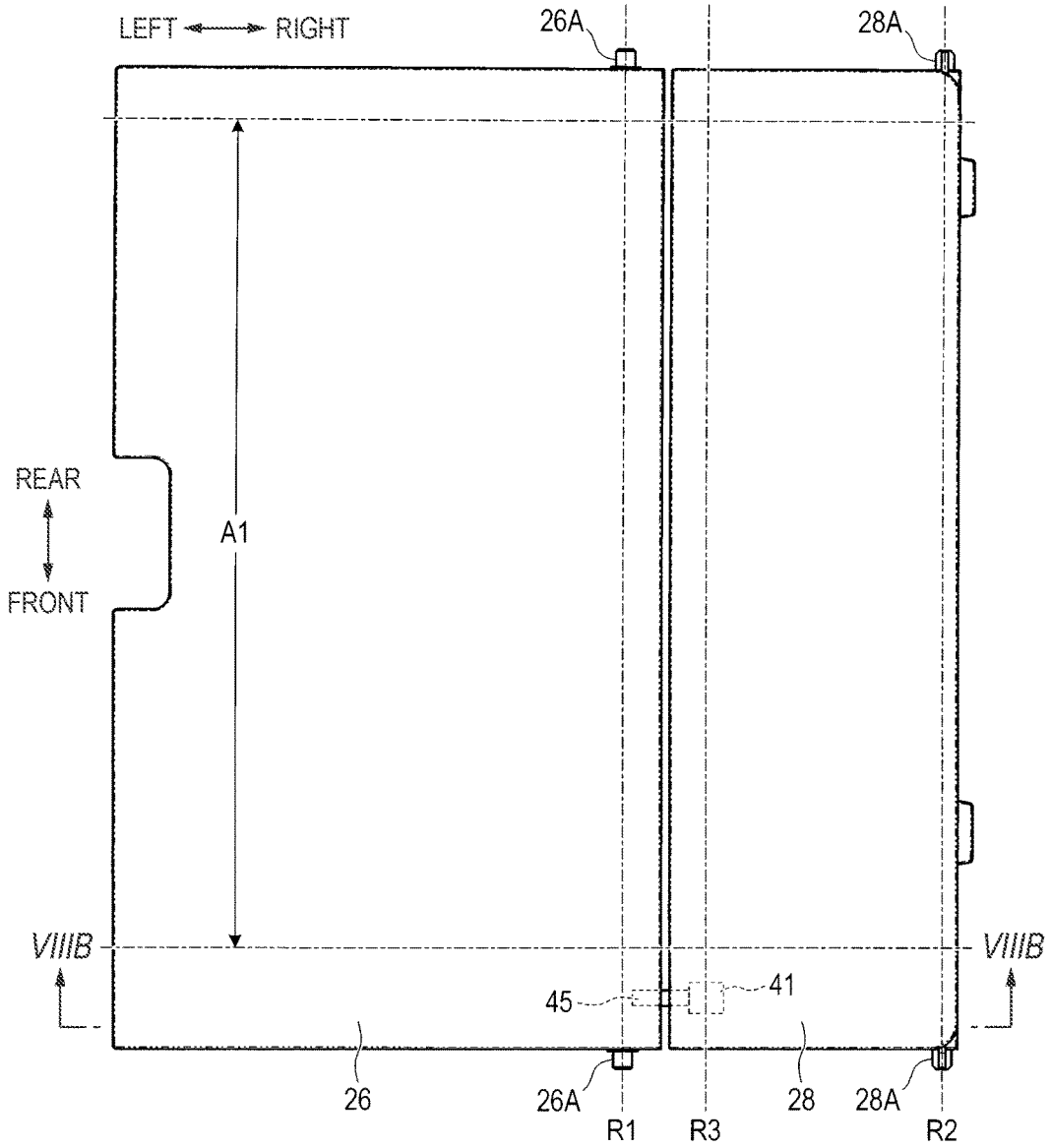
FIG. 8A is a plan view illustrating the central cover, the right cover and the restricting portion of a third illustrative embodiment.
Figure 8B:
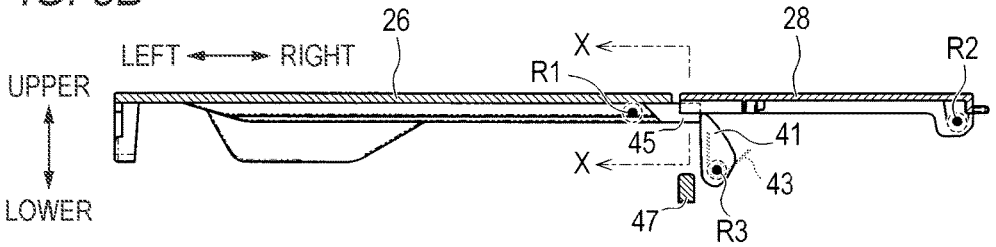
FIG. 8B is a sectional view taken along a line VIIIB-VIIIB of FIG. 8A.

Also in a third illustrative embodiment, as shown in FIGS. 8A and 8B, the shapes and the like of the restricting portion 41 and the pressing portion 45 are different from the first and second illustrative embodiments. For example, in the first and second illustrative embodiments, the width of the pressing portion 45 in the front and rear direction is wider than the width of the restricting portion 41 in the front and rear direction. However, in the third illustrative embodiment, the width of the pressing portion 45 in the front and rear direction is narrower than the width of the restricting portion 41 in the front and rear direction. Also, according to the third illustrative embodiment, at the state where the central cover 26 is located at the closed position, the pressing portion 45 protrudes rightwards in the substantially horizontal direction from the central cover 26, as seen from the front (refer to FIG. 8B).

At the state where the restricting portion 41 is located at the restricting position shown in FIG. 8B, the upper end of the restricting portion 41 is contacted to the right cover 28 located at the first position. The upper end of the restricting portion 41 and a surface of the restricting portion 41 at the left of the upper end define a sliding surface on which the restricting portion 41 slides relative to the pressing portion 45 contacting the pressing portion 45 while the restricting portion 41 is moved from the restricting position shown in FIG. 8B to the allowable position shown in FIG. 9A. A curved surface of the restricting portion 41, which is at the right of the upper end of the restricting portion 41, defines a guide surface that guides the right cover 28 when the right cover 28 is moved between the first position and the second position.

Figure 9A:
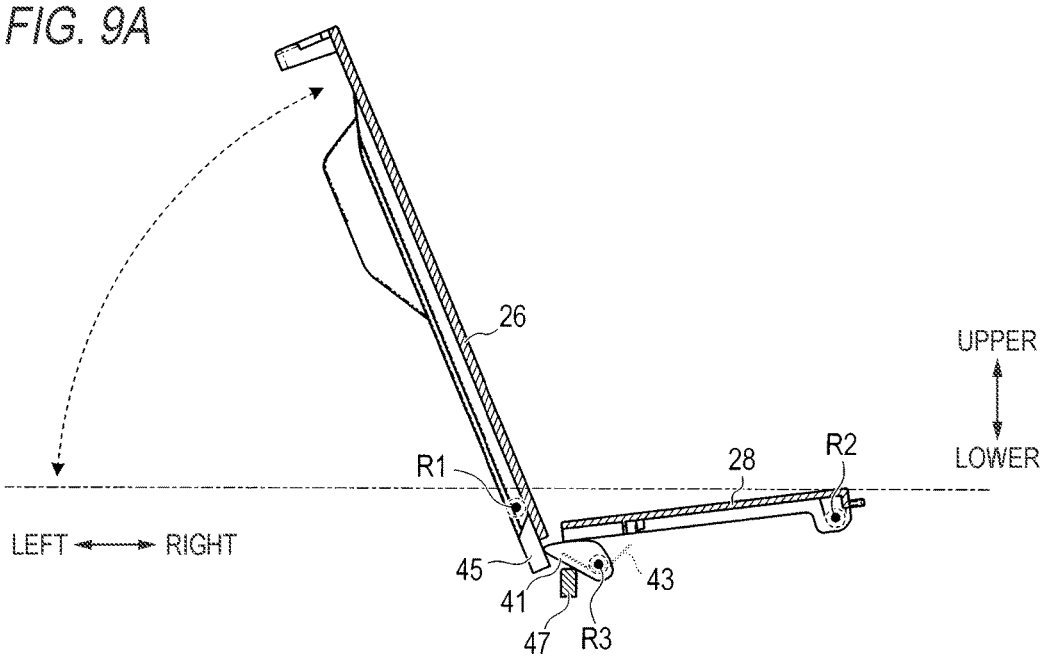
FIG. 9A illustrates the central cover rotated from the closed position toward the opened position by 67° and the right cover rotated in conjunction with the rotation of the central cover.

When the restricting portion 41 and the pressing portion 45 is provided, the first restricting portion 41 is moved contacting the pressing portion 45 until the central cover 26 is moved from the closed position shown in FIG. 8B to the position shown in FIG. 9A. At this time, the restricting portion 41 is moved from the restricting position to the allowable position. Also, the right cover 28 is moved from the first position to the second position. Then, while the central cover 26 is further moved from the position shown in FIG. 9A toward the opened position shown in FIG. 9B, the restricting portion 41 is kept at the allowable position and the right cover 28 is kept at the second position.

Figure 9B:
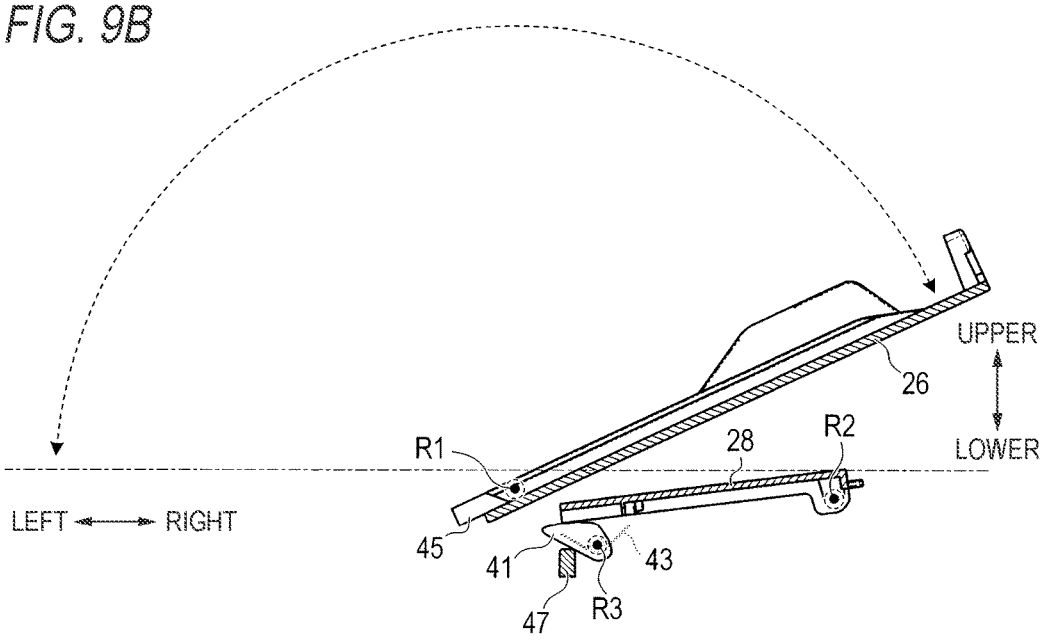
FIG. 9B illustrates the central cover rotated to the opened position and the right cover rotated in conjunction with the rotation of the central cover.

Also, while the central cover 26 is moved from the opened position shown in FIG. 9B to the position shown in FIG. 9A, the restricting portion 41 is kept at the allowable position and the right cover 28 is kept at the second position. Then, the pressing portion 45 presses the restricting portion 41 against the urging force from the urging member 43 and is moved by contacting the first part 441 until the central cover 26 is further moved from the position shown in FIG. 9A to the closed position shown in FIG. 8B. At this time, the restricting portion 41 is moved from the allowable position to the restricting position. Also, the right cover 28 is moved from the second position to the first position.

Therefore, when the configuration exemplified in the third illustrative embodiment is adopted, it is possible to accomplish the same operations and effects as the first and second illustrative embodiments. Also, when the load is applied to the right cover 28, it is possible to suppress the central cover 26 from being moved from the closed position toward the opened position.

Figure 10:
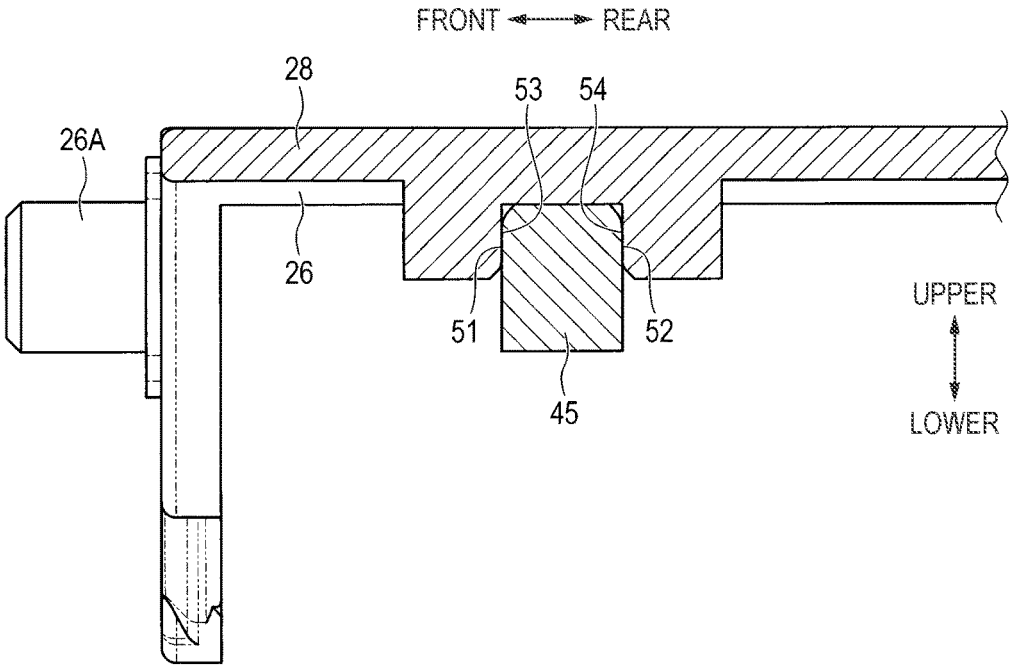
FIG. 10 is an enlarged sectional view of a part taken along a line X-X of FIG. 8B.

Further, in the third illustrative embodiment, as shown in FIG. 10, the pressing portion 45 has a first contact part 51 and a second contact part 52. The right cover 28 has a third contact part 53 and a fourth contact part 54. When the central cover 26 is located at the closed position, the pressing portion 45 is entered between the third contact part 53 and the fourth contact part 54, so that the first contact part 51 and the third contact part 53 are contacted to each other and the second contact part 52 and the fourth contact part 54 are contacted to each other. Thereby, the first contact part 51, the second contact part 52, the third contact part 53 and the fourth contact part 54 restrict the central cover 26 and the right cover 28 from being relatively moved in the width direction orthogonal to the sheet conveying direction.

Therefore, when the configuration exemplified in the third illustrative embodiment is adopted, as compared to a configuration where each of the central cover 26 and the right cover 28 is positioned with respect to the other member, it is possible to position the relative positions of the central cover 26 and the right cover 28 with precision, so that it is possible to improve an appearance when the central cover 26 and the right cover 28 form the outer covering surface.

Meanwhile, in this illustrative embodiment, a lower end of the first contact part 51 and a lower end of the second contact part 52 are chamfered so that an interval therebetween increases as it goes toward a downward direction, and an upper end of the third contact part 53 and an upper end of the fourth contact part 54 are chamfered so that an interval therebetween decreases as it goes toward an upward direction. By the configurations, even when the relative positions of the central cover 26 and the right cover 28 slightly deviate in the front and rear direction, it is possible to smoothly insert the third contact part 53 and the fourth contact part 54 between the first contact part 51 and the second contact part 52. Thereby, it is possible to appropriately correct the deviation of the central cover 26 and the right cover 28 in the front and rear direction.

(4) Fourth Illustrative Embodiment

Figure 11A:
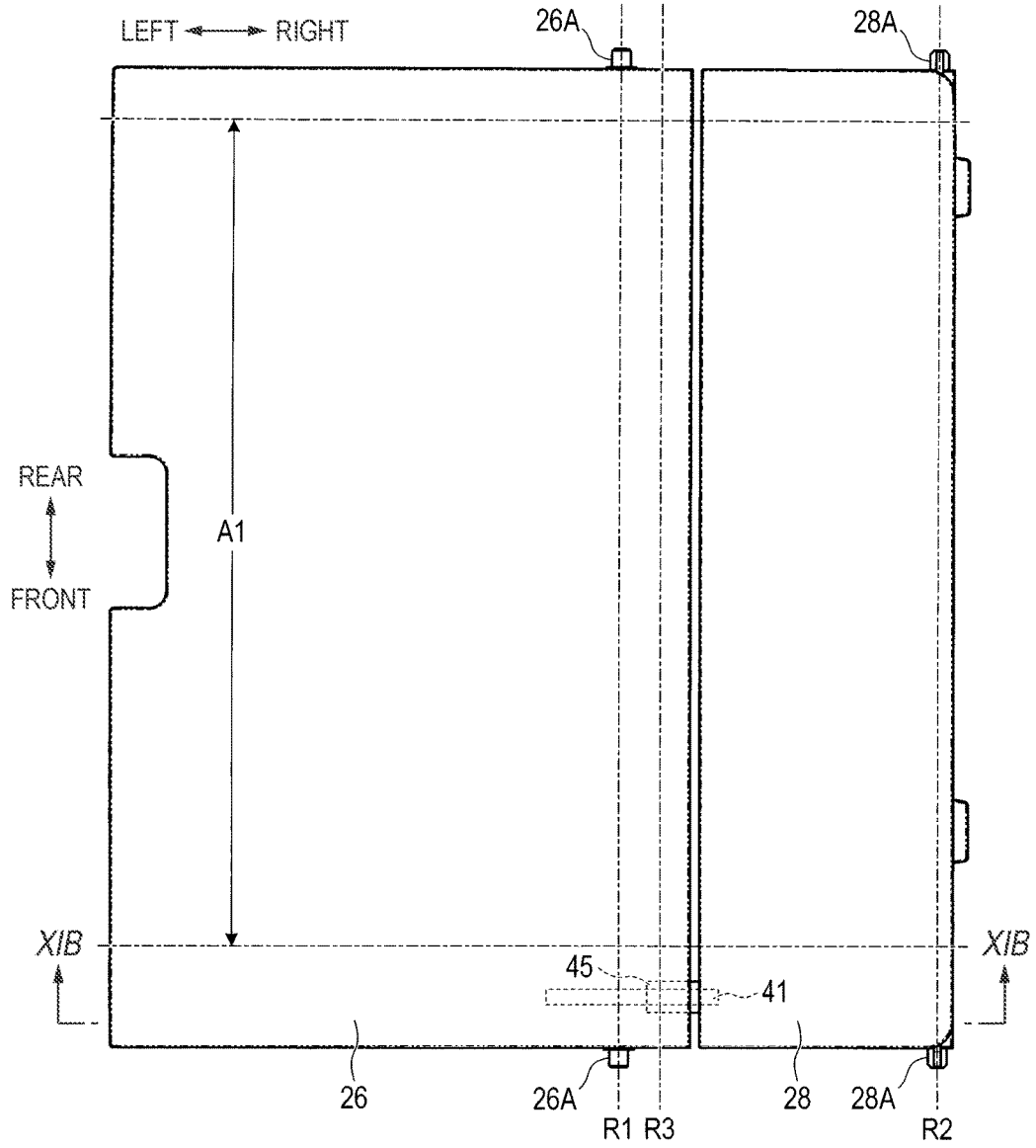
FIG. 11A is a plan view illustrating the central cover, the right cover and the restricting portion of a fourth illustrative embodiment.
Figure 11B:
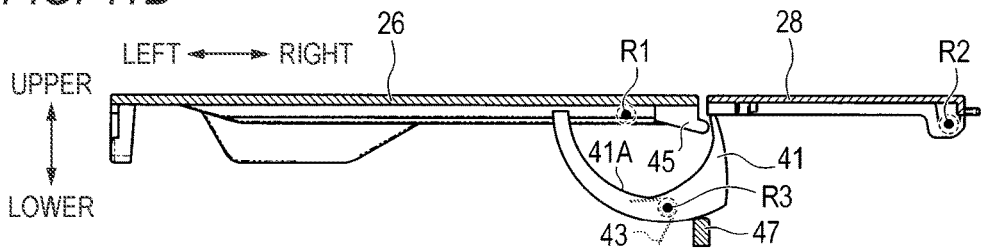
FIG. 11B is a sectional view taken along a line XIB-XIB of FIG. 11A.

Also in a fourth illustrative embodiment, as shown in FIGS. 11A and 11B, the shapes and the like of the restricting portion 41 and the pressing portion 45 are different from the first, second and third illustrative embodiments. Also, in the respective illustrative embodiments, the urging member 43 is configured to urge the restricting portion 41 in the direction of moving the same from the restricting position toward the allowable position. However, in the fourth illustrative embodiment, the urging member 43 is configured to urge the restricting portion 41 in the direction of moving the same from the allowable position (refer to FIG. 12B) toward the restricting position (refer to FIG. 12A). For this reason, when the restricting portion 41 is moved from the restricting position to the allowable position, the pressing portion 45 presses the restricting portion 41 against the urging force of the urging member 43.

Figure 12A:
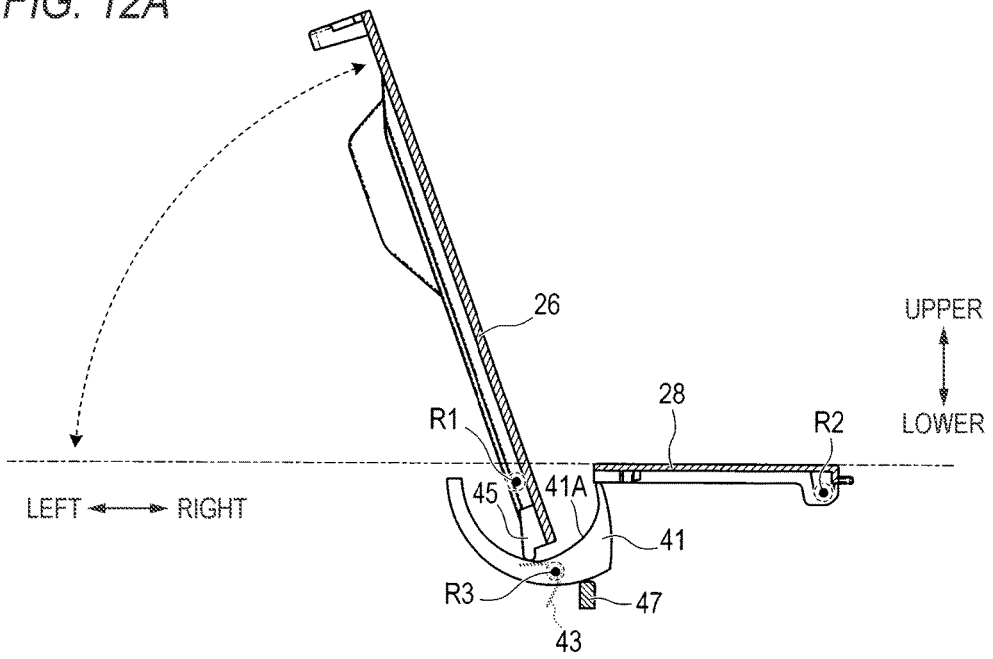
FIG. 12A illustrates the central cover rotated from the closed position toward the opened position by 70° and the right cover rotated in conjunction with the rotation of the central cover.

Also, in the fourth illustrative embodiment, unlike the first, second and third illustrative embodiments, the pressing portion 45 is moved without contacting the restricting portion 41 until the central cover 26 is moved from the closed position shown in FIG. 11B to the position shown in FIG. 12A. For this reason, the restricting portion 41 is not moved from the restricting position and the right cover 28 is not moved from the first position until the central cover 26 is moved from the closed position shown in FIG. 11B to the position shown in FIG. 12A.

Figure 12B:
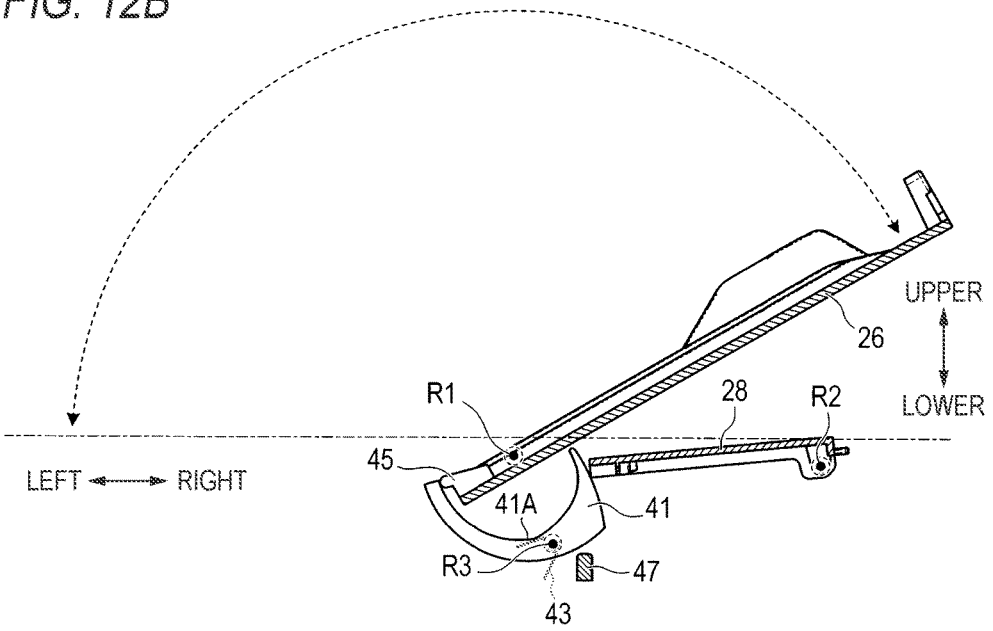
FIG. 12B illustrates the central cover rotated to the opened position and the right cover rotated in conjunction with the rotation of the central cover.

Then, while the central cover 26 is further moved from the position shown in FIG. 12A toward the opened position shown in FIG. 12B, the pressing portion 45 presses the restricting portion 41 against the urging force from the urging member 43, unlike the first, second and third illustrative embodiments. Thereby, the restricting portion 41 is moved from the restricting position to the allowable position. Also, as the restricting portion 41 is moved to the allowable position, the right cover 28 is moved from the first position to the second position. When the central cover 26 is moved to the opened position shown in FIG. 12B, the pressing portion 45 keeps the contact state with the restricting portion 41. This is also different from the first, second and third illustrative embodiments.

In the fourth illustrative embodiment, in order to implement the above-described behaviors, the restricting portion 41 has a concave surface 41A having a downwardly convex arc shape, as seen from the front, and is arranged with the concave surface 41A facing upwards, as shown in FIGS. 11B, 12A and 12B. A shape of the concave surface 41A is designed so that a distance from the central axis of rotation R1 to the concave surface 41A is shorter than a distance from the central axis of rotation R1 to the tip portion of the pressing portion 45 in a range of the concave surface 41A, which is at the left of a contact point of the pressing portion 45 and the concave surface 41A, when the restricting portion 41 is located at the restricting position shown in FIG. 12A. For this reason, when the pressing portion 45 is moved to the range of the left of the contact point, the pressing portion 45 is pressure-contacted to the concave surface 41A to rotate the restricting portion 41 toward the allowable position, as shown in FIG. 12B.

Also, the shape of the concave surface 41A is designed so that the distance from the central axis of rotation R1 to the concave surface 41A is longer than the distance from the central axis of rotation R1 to the tip portion of the pressing portion 45 in a range of the concave surface 41A, which is at the right of the contact point of the pressing portion 45 and the concave surface 41A, when the restricting portion 41 is located at the restricting position shown in FIG. 12A. For this reason, when the pressing portion 45 is moved to the range of the right of the contact point, the pressing portion 45 is spaced from the concave surface 41A, as shown in FIG. 11B. At this time, the restricting portion 41 is urged in a clockwise direction of FIG. 12A by the urging member 43. However, when the restricting portion 41 is contacted to the stopper 47, the restricting portion 41 cannot be further rotated in the clockwise direction. For this reason, even when the pressing portion 45 is rotated to the position shown in FIG. 11B, the restricting portion 41 is kept at the same restricting position as FIG. 12A, in FIG. 11B.

As described above, according to the fourth illustrative embodiment, the urging direction of the restricting portion 41 by the urging member 43, the timing at which the pressing portion 45 and the restricting portion 41 are contacted to each other, the timing at which the central cover 26 and the right cover 28 start to be moved, and the like are different from the first, second and third illustrative embodiments. However, even when the configuration exemplified in the fourth illustrative embodiment is adopted, it is possible to accomplish the same operations and effects as the first, second and third illustrative embodiments. Also, when the load is applied to the right cover 28, it is possible to suppress the central cover 26 from being moved from the closed position toward the opened position.

(5) Other Illustrative Embodiments

Although the exemplary illustrative embodiments of the sheet conveying device and the image reading apparatus have been described, the present invention is not limited to the exemplary illustrative embodiments and can be implemented in a variety of forms without departing from the technical spirit of the present invention.

For example, in the illustrative embodiments, the torsion coil spring has been exemplified as the urging member 43. However, a spring, rather than the torsion coil spring, may also be used. For example, a compression spring, a tension spring and the like may be adopted as the urging member 43.

Alternatively, the restricting portion 41 may be moved between the restricting position and the allowable position by a configuration, rather than the spring. For example, the central cover 26 and the restricting portion 41 may be configured to interlock with each other by interposing a gear mechanism between the central cover 26 and the restricting portion 41. Also, the central cover 26 and the restricting portion 41 may be configured to interlock with each other by coupling the central cover 26 and the restricting portion 41 with a belt. Further, the central cover 26 and the restricting portion 41 may be configured to interlock with each other by a link, a slide mechanism and the like. That is, the structure for operating the restricting portion 41 is not particularly limited, and the restricting portion 41 may be configured to move between the restricting position and the allowable position in conjunction with the opening and closing of the central cover 26.

Also, in the above illustrative embodiments, when one restricting portion 41 is located at the restricting position, it is contacted to the right cover 28 at one point. However, a plurality of restricting portions 41 each of which is configured to be independently movable may be provided. Also, the single restricting portion 41 is configured so as not to be independently moved may be contacted to the right cover 28 at a plurality of points.

Also, in the above illustrative embodiment, the ADF unit 6 provided for the multi-function device 1 has been exemplified as the sheet conveying device. However, it is arbitrary to adopt the above configuration for the multi-function device, and the above configuration may be adopted for an image reading apparatus having a single function, a copier, a facsimile apparatus and the like.

(6) Configurations of Illustrative Embodiments

From the above exemplary illustrative embodiments, it can be understood that the sheet conveying device and the image reading apparatus described in the specification may further have the following configurations.

First, the sheet conveying device or the image reading apparatus may have an urging member configured to apply an urging force to the restricting portion, and a pressing portion configured to be integrally movable with the first cover and to contact the restricting portion upon movement thereof, thereby pressing the restricting portion in a resistance direction of the urging force from the urging member. When the first cover is moved from the closed position to the opened position, the restricting portion may be applied with the urging force from the urging member and may be thus moved from the restricting position to the allowable position, and when the first cover is moved from the opened position toward the closed position, the pressing portion may move the restricting portion from the allowable position to the restricting position against the urging force from the urging member.

In this case, the sheet conveying device or the image reading apparatus may have a stopper that is contacted to the restricting portion to suppress the restricting portion from being moved to a position beyond the allowable position when the restricting portion is applied with the urging force from the urging member and is thus moved to the allowable position.

Alternatively, the sheet conveying device or the image reading apparatus may have an urging member configured to apply an urging force to the restricting portion, and a pressing portion configured to be integrally movable with the first cover and to contact the restricting portion upon movement thereof, thereby pressing the restricting portion in a direction of resisting the urging force from the urging member. When the first cover is moved from the opened position toward the closed position, the restricting portion may be applied with the urging force from the urging member and may be thus moved from the allowable position to the restricting position, and when the first cover is moved from the closed position to the opened position, the pressing portion may move the restricting portion from the restricting position to the allowable position against the urging force from the urging member.

Also in this case, the sheet conveying device or the image reading apparatus may have a stopper that is contacted to the restricting portion to suppress the restricting portion from being moved to a position beyond the allowable position when the urging force is applied to the restricting portion from the urging member and is thus moved to the restricting position.

According to the sheet conveying device or the image reading apparatus configured as described above, it is possible to move the restricting portion between the restricting position and the allowable position by using the urging member and the pressing portion. Also, when the stopper is provided, it is possible to suppress the movement of the restricting portion by using the stopper when the restricting portion is moved to the predetermined restricting position or allowable position.

Also, in the sheet conveying device or the image reading apparatus, the first cover may be configured so that a part of an entire range in a width direction orthogonal to a sheet conveying direction on the first cover is used as a conveyance area of the sheet, and the pressing portion may be provided at a position deviating from the conveyance area.

According to the sheet conveying device or the image reading apparatus configured as described above, the first cover is contacted to the restricting portion at the pressing portion located at the position deviating from the conveyance area. For this reason, the sheet being fed to the conveyor or the sheet being discharged from the conveyor is not contacted to the pressing portion. Therefore, it is not necessary to design a configuration where the pressing portion is positioned in the conveyance area, for example, a shape of the pressing portion with which the sheet is difficult to interfere, and it is possible to design the shape, structure and the like of the pressing portion on the basis of the functions thereof Also, in the sheet conveying device or the image reading apparatus, the second cover may be pivotally supported to be rotatable at both ends in the width direction orthogonal to the sheet conveying direction, and the restricting portion may have a first part capable of being contacted to the pressing portion, a second part capable of being contacted to the second cover at a substantial center in the width direction, and a coupling part configured to couple the first part and the second part so that the first part and the second part can be integrally moved.

In this case, the sheet conveying device or the image reading apparatus may have a base part configured to rotatably support the restricting portion, the coupling part may be rotatably supported to the base part, the first part may be attached to one end of the coupling part, and the second part may be attached to the other end of the coupling part.

According to the sheet conveying device or the image reading apparatus configured as described above, the second part of the restricting portion is contacted to the second cover substantially to the center of the second cover in the width direction. Therefore, since the restricting portion is contacted to the place at which the bending is likely to occur and which is located at the position spaced from both ends in the width direction, to which the second cover is pivotally supported, it is possible to effectively suppress the bending of the second cover.

Also, in the sheet conveying device or the image reading apparatus, the first cover may be configured so that a part of an entire range in a width direction orthogonal to the sheet conveying direction on the first cover is used as a conveyance area of the sheet, the pressing portion may be provided at a position deviating from the conveyance area, and the restricting portion may be configured to contact the pressing portion and the second cover at a position deviating from the conveyance area.

In this case, the pressing portion may be a part that is formed integrally with the first cover and protrudes from the second surface of the first cover at a state where the first cover is located at the closed position.

According to the sheet conveying device or the image reading apparatus configured as described above, the first cover is contacted to the restricting portion at the pressing portion located at the position deviating from the conveyance area, as described above. For this reason, the sheet being fed to the conveyor or the sheet being discharged from the conveyor is not contacted to the pressing portion. Therefore, it is not necessary to design a configuration where the pressing portion is positioned in the conveyance area, for example, a shape of the pressing portion with which the sheet is difficult to interfere, and it is possible to design the shape, structure and the like of the pressing portion on the basis of the functions thereof. Further, the restricting portion is contacted to the second cover at the position deviating from the conveyance area. Therefore, since it is possible to concentrate an arrangement range of the restricting portion at a position deviating from the conveyance area, it is possible to make the restricting portion compact.

Also, in the sheet conveying device or the image reading apparatus, the pressing portion may have a first contact part and a second contact part, and the second cover may have a third contact part and a fourth contact part. When the first cover is located at the closed position, the first contact part and the third contact part may be contacted to each other and the second contact part and the fourth contact part may be contacted to each other, so that the first cover and the second cover are restricted from being relatively moved in the width direction orthogonal to the sheet conveying direction.

According to the sheet conveying device or the image reading apparatus configured as described above, when the first cover is located at the closed position, the first cover and the second cover are directly positioned as regards the relative positions thereof by the first contact part, the second contact part, the third contact part and the fourth contact part, so that the first cover and the second cover are not relatively moved in the width direction orthogonal to the sheet conveying direction. Therefore, as compared to a configuration where each of the first cover and the second cover is positioned with respect to the other member, it is possible to position the relative positions of the first cover and the second cover with precision, so that it is possible to improve an appearance when the first cover and the second cover form the outer covering surface.

According to the sheet conveying device or the image reading apparatus configured as described above, when the first cover is located at the closed position, the first cover and the second cover are directly positioned as regards to the relative positions thereof by the first contact part, the second contact part, the third contact part and the fourth contact part, so that the first cover and the second cover are not relatively moved in the width direction orthogonal to the sheet conveying direction. Therefore, as compared to a configuration where each of the first cover and the second cover is positioned with respect to the other member, it is possible to position the relative positions of the first cover and the second cover with precision, so that it is possible to improve an appearance when the first cover and the second cover form the outer covering surface.

What is claimed is:

1. A sheet conveying device comprising:

a conveyor configured to convey a sheet along a predetermined conveyance path;

a first cover configured to be pivotable on a first axis between a closed position and an opened position, wherein the first cover is configured to form a part of an outer covering surface of the sheet conveying device by a first surface at the closed position and to function as a support member configured to support a sheet to be fed to the conveyor or a sheet discharged from the conveyor on a second surface opposite to the first surface at the opened position;

a second cover configured to be pivotable on a second axis between a first position and a second position, and configured to be in conjunction with the first cover, wherein the second cover is located at the first position when the first cover is located at the closed position and is configured to form a part of the outer covering surface at a position adjacent to the first cover at the first position, and wherein the second cover is configured to be moved from the first position to the second position when the first cover is moved from the closed position to the opened position; and a restricting portion movable between a restricting position at which the second cover is restricted from being moved from the first position toward the second position and an allowable position at which the second cover is allowed to be moved from the first position toward the second position, wherein the restricting portion is located at the restricting position when the first cover is located at the closed position, wherein the restricting portion is moved from the restricting position to the allowable position in conjunction with the first cover when the first cover is moved from the closed position toward the opened position, wherein the restricting portion is configured to be contactable and separable with respect to the first cover, and wherein the restricting portion and the first cover are separate parts and the restricting portion is configured to movable relative to a third axis which is different from the first axis and the second axis.

2. The sheet conveying device according to claim 1, further comprising:

an urging member configured to apply an urging force to the restricting portion; and a pressing portion integrally movable with the first cover, the pressing portion, when being moved, being configured to contact the restricting portion and to press the restricting portion in a direction of resisting the urging force from the urging member, wherein when the first cover is moved from the closed position toward the opened position, the restricting portion receives the urging force from the urging member and is moved from the restricting position to the allowable position, and wherein when the first cover is moved from the opened position toward the closed position, the pressing portion moves the restricting portion from the allowable position to the restricting position against the urging force from the urging member.

3. The sheet conveying device according to claim 2, wherein the pressing portion is configured to contact the restrict portion when the first cover is located at the closed position.

4. The sheet conveying device according to claim 2, further comprising:

a stopper configured to be contacted to the restricting portion to prevent the restricting portion from being moved to a position beyond the allowable position when the restricting portion is applied with the urging force from the urging member and is moved to the allowable position.

5. The sheet conveying device according to claim 2, wherein the first cover is configured such that a part of an entire range in a width direction orthogonal to a sheet conveying direction on the first cover is used as a conveyance area of the sheet, and wherein the pressing portion is provided at a position outside the conveyance area.

6. The sheet conveying device according to claim 1, further comprising:

an urging member configured to apply an urging force to the restricting portion; and a pressing portion integrally movable with the first cover, the pressing portion, when being moved, being configured to contact the restricting portion and to press the restricting portion in a direction of resisting the urging force from the urging member, wherein when the first cover is moved from the opened position toward the closed position, the restricting portion receives the urging force from the urging member and is moved from the allowable position to the restricting position, and wherein when the first cover is moved from the closed position toward the opened position, the pressing portion moves the restricting portion from the restricting position to the allowable position against the urging force from the urging member.

7. The sheet conveying device according to claim 6, wherein the pressing portion is configured to contact the restricting portion when the first cover is located at the closed position.

8. The sheet conveying device according to claim 6, further comprising:

a stopper configured to be contacted to the restricting portion to prevent the restricting portion from being moved to a position beyond the restricting position when the restricting portion is applied with the urging force from the urging member and is moved to the restricting position.

9. The sheet conveying device according to claim 6, wherein the first cover is configured such that a part of an entire range in a width direction orthogonal to a sheet conveying direction on the first cover is used as a conveyance area of the sheet, and wherein the pressing portion is provided at a position outside the conveyance area.

10. The sheet conveying device according to claim 1, when the first cover is located at the closed position, an end edge of the second cover is located between the first axis of the first cover and the third axis of the restricting portion as seen in an orthogonal direction to the first cover.

11. The sheet conveying device according to claim 1, when the first cover is located at the closed position, the third axis of the restricting portion is located between the first axis of the first cover and an end edge of the second cover as seen in an orthogonal direction to the first cover.

* * * * *